US010540955B1

(12) United States Patent
Milani et al.

(10) Patent No.: US 10,540,955 B1
(45) Date of Patent: Jan. 21, 2020

(54) DUAL-DRIVER LOUDSPEAKER WITH ACTIVE NOISE CANCELLATION

(71) Applicant: Amazon Technologies, Inc., Seattle, WA (US)

(72) Inventors: Ali Abdollahzadeh Milani, San Francisco, CA (US); Samuel Jesse Anderson, Sunnyvale, CA (US)

(73) Assignee: AMAZON TECHNOLOGIES, INC., Seattle, WA (US)

( * ) Notice: Subject to any disclaimer, the term of this patent is extended or adjusted under 35 U.S.C. 154(b) by 0 days.

(21) Appl. No.: 16/104,249

(22) Filed: Aug. 17, 2018

Related U.S. Application Data

(60) Provisional application No. 62/665,288, filed on May 1, 2018.

(51) Int. Cl.

| | |
|---|---|
| ***H04R 1/10*** | (2006.01) |
| ***H04R 1/24*** | (2006.01) |
| ***G10K 11/178*** | (2006.01) |

(52) U.S. Cl.

CPC .. *G10K 11/17823* (2018.01); *G10K 11/17825* (2018.01); *G10K 11/17853* (2018.01); *G10K 11/17881* (2018.01); *H04R 1/1016* (2013.01); *H04R 1/24* (2013.01); *G10K 2210/1081* (2013.01); *G10K 2210/3011* (2013.01); *G10K 2210/3026* (2013.01); *G10K 2210/3028* (2013.01)

(58) Field of Classification Search

USPC ..... 381/71.6, 71.7, 71.1, 71.11, 103, 122, 381/123, 150, 402

See application file for complete search history.

(56) References Cited

U.S. PATENT DOCUMENTS

| | | | | |
|---|---|---|---|---|
| 8,804,974 B1 * | 8/2014 | Melanson | ..... | H03G 3/32 381/57 |
| 2006/0251266 A1 * | 11/2006 | Saunders | ..... | G10K 11/178 381/71.1 |

* cited by examiner

*Primary Examiner* — Yosef K Laekemariam

(74) *Attorney, Agent, or Firm* — Pierce Atwood LLP

(57) ABSTRACT

A system and method includes a loudspeaker having a first, low-frequency driver and a second, high-frequency driver. An error microphone is disposed near the loudspeaker and receives sound output by both drivers as well as noise. An estimation of the secondary path between the drivers and the microphones is determined, and playback audio is applied to the estimation. The output of the estimation is subtracted from the output of the microphone to determine anti-noise. This anti-noise is used to modify audio data sent to the first, low-frequency driver; the audio data is sent directly to the second, high-frequency driver.

20 Claims, 9 Drawing Sheets

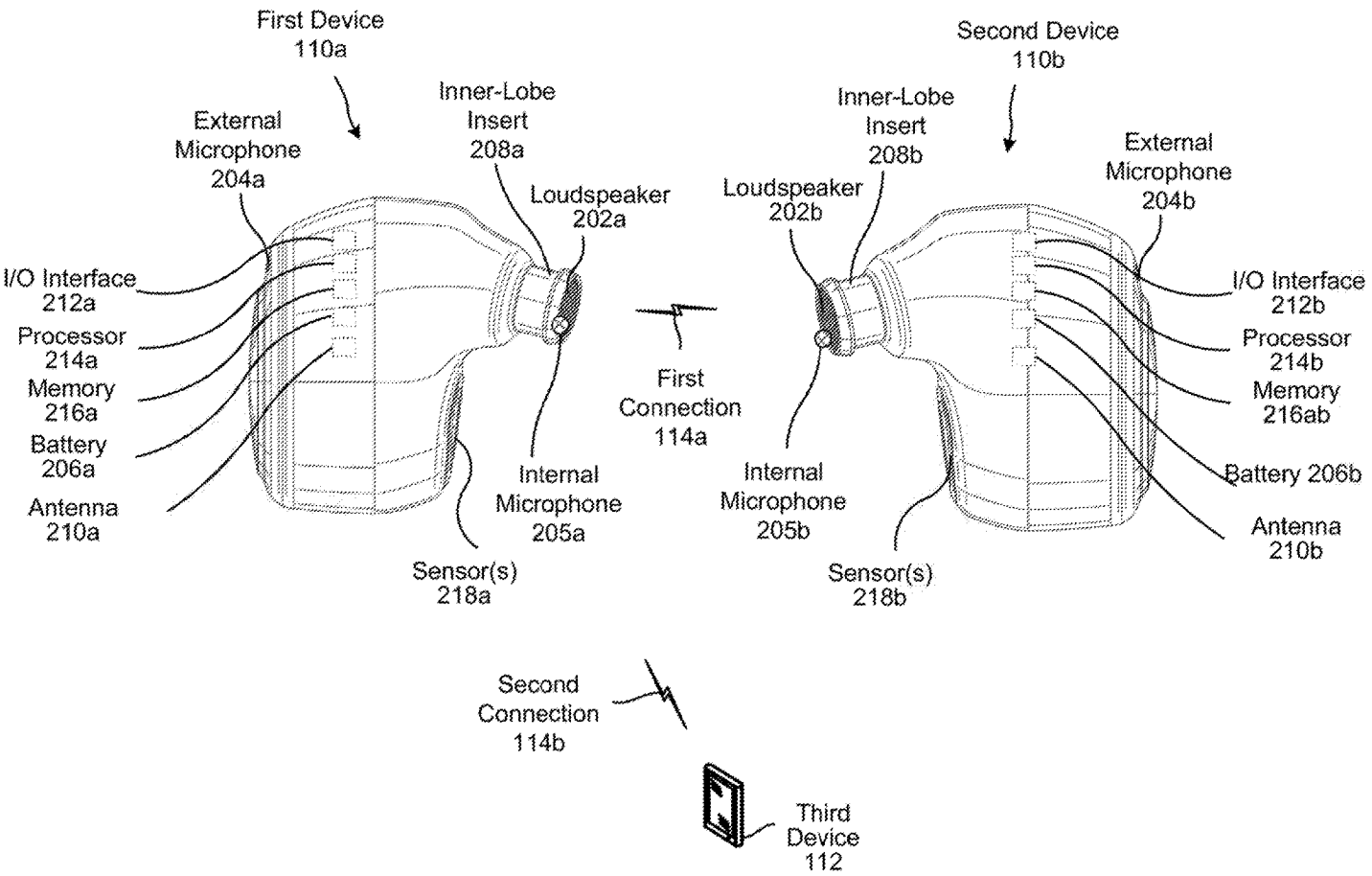
FIG. 2A
FIG. 2B
First Device 110a
Second Device 110b
External Microphone 204a
External Microphone 204b
Inner-Lobe Insert 208a
Inner-Lobe Insert 208b
Loudspeaker 202a
Loudspeaker 202b
Internal Microphone 205a
Internal Microphone 205b
Sensor(s) 218a
Sensor(s) 218b
I/O Interface 212a
I/O Interface 212b
Processor 214a
Processor 214b
Memory 216a
Memory 216ab
Battery 206a
Battery 206b
Antenna 210a
Antenna 210b
First Connection 114a
Second Connection 114b
Third Device 112

DUAL-DRIVER LOUDSPEAKER WITH ACTIVE NOISE CANCELLATION

CROSS-REFERENCE TO RELATED APPLICATION

This application is a non-provisional of, and claims the benefit of priority of, U.S. Provisional Patent Application No. 62/665,288, filed May 1, 2018, and entitled "USING BANDWIDTH-LIMITED AUDIO DEVICES," in the name of Ali Abdollahzadeh Milani, which is hereby incorporated by reference herein in its entirety.

BACKGROUND

Wireless audio devices, such as earbuds or headphones, may be used to communicate wirelessly with a user device, such as a smartphone, smartwatch, or similar device, and with each other. The wireless earbuds may be used to output audio sent from the user device, such as music, as part of two-way communications, such as telephone calls, and/or to receive audio for speech recognition.

BRIEF DESCRIPTION OF DRAWINGS

For a more complete understanding of the present disclosure, reference is now made to the following description taken in conjunction with the accompanying drawings.

FIGS. 2A and 2B are diagrams of components of noise-cancelling audio devices according to embodiments of the present disclosure.

DETAILED DESCRIPTION

Figure 1:
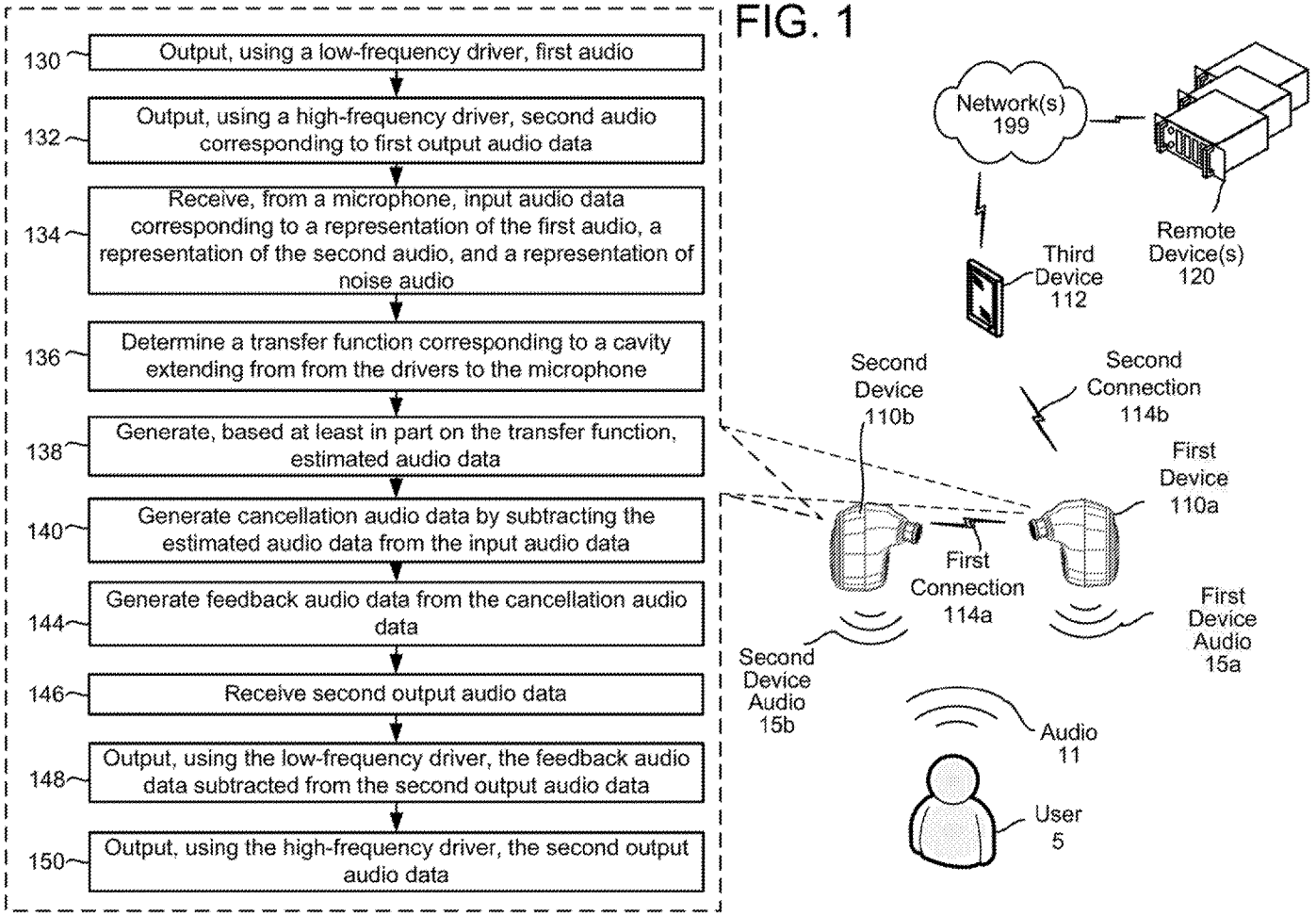
FIG. 1 illustrates a system configured to cancel noise according to embodiments of the present disclosure.

Some electronic devices may include an audio-based input/output interface. A user may interact with such a device—which may be, for example, a smartphone, smart speaker, tablet, computer, or other speech-controlled device—partially or exclusively using his or her voice and ears. Exemplary interactions include listening to music or other audio, communications such as telephone calls, audio messaging, and video messaging, and/or audio input for search queries, weather forecast requests, navigation requests, or other such interactions. The device may include one or more microphones for capturing voice input and hardware and/or software for converting the voice input into audio data. The device may include an audio output device, such as a loudspeaker, for outputting audio that in some embodiments responds to and/or prompts for the voice input.

Use of the above-described electronic device by its audio-based input/output interface may, at times, be inconvenient, difficult, or impossible. Sometimes, such as while exercising, working, or driving, the user's hands may be occupied, and the user may not be able to hold the device in such a fashion as to effectively interact with the device's speech interface. Other times, the level of ambient noise may be too high for the device to accurately detect speech from the user or too high for the user to understand audio output from the device. In these situations, the user may prefer to connect headphones to the device and interact with the audio-based input/output interface therewith. As the term is used herein, "headphones" may refer to any hands-free, wearable audio input/output device and includes headsets, earphones, earbuds, or any similar device. For added convenience, the user may choose wireless headphones, which communicate with the device—and optionally each other—via a wireless connection, such as Bluetooth, WI-FI, near-field magnetic induction (NFMI), cellular long-term extension (LTE), or any other type of wireless connection. Wireless earbuds may be more desirable and/or convenient to users because the earbuds do not require a wire or cord connecting them; such a cord may be distracting and/or uncomfortable.

In the present disclosure, for clarity, headphone components that are capable of communication with both a third device (such as a phone, tablet, etc.) and each other are referred to as "wireless earbuds," but the term "earbud" does not limit the present disclosure to any particular type of wired or wireless headphones. The present disclosure may further differentiate between a "right earbud," meaning a headphone component disposed in or near a right ear of a user, and a "left earbud," meaning a headphone component disposed in or near a left ear of a user. A "primary" earbud communicates with both a "secondary" earbud, using a first wireless connection (such as a Bluetooth or NFMI connection); the primary earbud further communicates with a third device (such as a smartphone, smart watch, or similar device) using a second connection (such as a Bluetooth connection). The secondary earbud communicates directly with only with the primary earbud and does not communicate using a dedicated connection directly with the smartphone; communication therewith may pass through the primary earbud via the first wireless connection.

The primary and secondary earbuds may include similar hardware and software; in other instances, the secondary earbud contains different hardware/software included in the primary earbud. If the primary and secondary earbuds include similar hardware and software, they may trade the roles of primary and secondary prior to or during operation. In the present disclosure, the primary earbud may be referred to as the "first device," the secondary earbud may be referred to as the "second device," and the smartphone or other device may be referred to as the "third device." The first, second, and/or third devices may communicate over a network, such as the Internet, with one or more server devices, which may be referred to as "remote device(s)."

Each of the primary and secondary earbuds may also include a loudspeaker; the loudspeaker may include a single audio-output device or a plurality of audio-output device. As the term is used herein, a loudspeaker refers to any audio-output device; in a system of multiple audio-output devices, however, the system as a whole may be referred to as a loudspeaker while the plurality of audio-output devices therein may each be referred to as a "driver."

Each driver may output different ranges of frequencies of sound. For example, a first, low-frequency driver may output sound having frequencies mostly below a cutoff frequency, and a second, high-frequency driver may output sound having frequencies mostly above a cutoff frequency.

A type of filter called a "crossover filter" may be used to divide audio data into separate frequency ranges, and each frequency range may be sent to a different driver. A high-frequency driver may be referred to as a "tweeter," and a low-frequency driver may be referred to as a "woofer" or "subwoofer." The present disclosure is not, however, limited to any particular number or type of drivers.

In some embodiments, a loudspeaker including a single audio-output device may include a "dynamic driver" as the audio-output device. A loudspeaker including multiple audio-output device may include "balanced-armature drivers" as each audio-output device. The present disclosure is not limited, however, to any particular type or combinations of audio-output devices.

A balanced-armature driver may include a coil of electric wire wrapped around an armature; the coil is disposed between two magnets, and changes in the current in the coil causes attraction and/or repulsion between it and the magnets, thereby creating sound using variations in the current. A balanced armature driver may be referred to as "balanced" because there may be no net force on the armature when it is centered in the magnetic field generated by the magnets and when the current is not being varied.

A dynamic driver may include a diaphragm attached to a voice coil. When a current is applied to the voice coil, the voice coil moves between two magnets, thereby causing the diaphragm to move and produce sound. Dynamic drivers may thus be also known as "moving-coil drivers." Dynamic drivers may have a greater frequency range of output sound when compared to balanced-armature drivers but may be larger and/or more costly.

Active-noise cancellation (ANC), also referred to as active-noise control, refers to systems and methods for reducing or cancelling unwanted ambient sound or "noise" by producing a waveform, referred to herein as "anti-noise" or "cancellation data," having an opposite or negative amplitude—but similar absolute value—compared to the noise. For example, if a noise signal corresponds to $\sin \Theta$, the anti-noise signal corresponds to $-\sin \Theta$. The anti-noise is output such that it cancels the noise at a point of interest, such as a point at or near where an ear of a user is disposed. The anti-noise may instead or in addition be combined with audio output or playback, such as audio output corresponding to music or voice, such that when the audio output collides with the noise, the noise is cancelled from the audio output. ANC may not function adequately when using some loudspeakers, such as balanced-armature drivers, however, and undesired noise may not be cancelled at least because latency associated with the ANC is too high and/or because high-frequency noise is not adequately cancelled.

The present disclosure offers a system and method for cancelling noise in a multi-driver system. An error microphone receives audio from a first, low-frequency driver and a second, high-frequency driver; the error microphone further receives noise audio. The path between the drivers and the microphone may be referred to herein as the "secondary path," and may be denoted by the transfer function S(z). An adaptive controller may be used to configure an estimation $\hat{S}(z)$ of the secondary path S(z) by configuring a filter, such as a finite-impulse response (FIR) or infinite-impulse response (IIR) filter, such that an error between the noise and generated anti-noise is minimized. The generated anti-noise or cancellation data may be generated by applying playback audio data to an input of the estimation $\hat{S}(z)$ of the secondary path S(z) and subtracting an output of the estimation $\hat{S}(z)$ of the secondary path S(z) from audio data received by the error microphone. The anti-noise or cancellation data may be modified by a feedback controller; the anti-noise and/or modified anti-noise may then be used to modify playback audio data before it is sent to the low-frequency driver for output. The playback audio is sent directly to the high-frequency driver without modification using the anti-noise.

FIG. 1 illustrates a system for performing ANC using a first device 110*a* (e.g., a primary earbud) and/or a second device 110*b* (e.g., a secondary earbud). The first device 110*a* and the second device 110*b* may communicate using a first wireless connection 114*a*, which may be a Bluetooth, NFMI, or similar connection. The first device 110*a* may communicate with a third device 112, such as a smartphone, smart watch, or similar device, using a second connection 114*b*, which may also be a Bluetooth or similar connection. The present disclosure may refer to particular Bluetooth protocols, such as classic Bluetooth, Bluetooth Low Energy ("BLE" or "LE"), Bluetooth Basic Rate ("BR"), Bluetooth Enhanced Data Rate ("EDR"), synchronous connection-oriented ("SCO"), and/or enhanced SCO ("eSCO"), but the present disclosure is not limited to any particular Bluetooth or other protocol. In some embodiments, however, a first wireless connection 114*a* between the first device 110*a* and the second device 110*b* is a low-power connection such as BLE; the second wireless connection 114*b* may include a high-bandwidth connection such as EDR in addition to or instead of a BLE connection. The third device 112 may communicate with one or more remote device(s) 120, which may be server devices, via a network 199, which may be the Internet, a wide- or local-area network, or any other network. The first device 110*a* may output first output audio 15*a*, and the second device 110*b* may output second output audio 15*b*. The first device 110*a* and second device 110*b* may capture input audio 11 from a user 5, process the input audio 11, and/or send the input audio 11 and/or processed input audio to the third device 112 and/or remote device(s) 120.

In various embodiments, the first and/or second devices 110*a*/110*b* output (130), using a first, low-frequency driver, first audio and output (132) using a second, high-frequency driver, second audio corresponding to first output audio data. The first and/or second devices 110*a*/110*b* receive (134), from a microphone, input audio data corresponding to a representation of the first audio, a representation of the second audio, and a representation of noise audio. As explained further herein, the first audio and/or second audio may be modified by a transfer function S(z) corresponding to a cavity extending between the drivers and microphone; the amount and type of modification may be defined by, for example, the size and shape of the cavity disposed between the drivers and the microphone, the type of drivers and microphone, the material defining the walls of the cavity, or any other such attribute of the transfer function S(z). The transfer function S(z) may also be referred to herein as the "secondary path."

The first and/or second devices 110*a*/110*b* determine (136) a transfer function $\hat{S}(z)$ corresponding to an estimation of the transfer function S(z) and generate (138), based at least in part on the determined transfer function $\hat{S}(z)$, estimated audio data. As explained further herein, the estimated audio data may be produced by the transfer function $\hat{S}(z)$ generated by, for example, an FIR filter that may be updated by an adaptive controller, which may use, for example, a least-means-square algorithm to determine an error between noise and anti-noise and/or between the estimation and the output audio data. The adaptive controller may update the FIR filter by changing one or more parameters/coefficients of the filter in accordance with the error. For example, if a gradient associated with the error is positive, one or more coefficients of the filter may be decreased, while if the gradient is negative, one or more coefficients of the filter may be decrease. The magnitude of the change to the one or more coefficients may be determined by the magnitude of the gradient.

The first and/or second devices 110*a*/110*b* generate (140) cancellation audio data, which may correspond to anti-noise, by subtracting the estimated audio data from the input audio data. A feedback controller generates (144) feedback audio data from the cancellation audio data. The first and/or second devices 110*a*/110*b* receive (146) second output audio data; the first and/or second devices 110*a*/110*b* output (148), using the low-frequency driver, the feedback audio data audio data subtracted from the second output audio data, and output (50), using the high-frequency driver, the second output audio data.

FIGS. 2A and 2B illustrate additional features of an embodiment of the first device 110*a* and second device 110*b*, respectively. As shown, the first device 110*a* and second device 110*b* have similar features; in other embodiments, as noted above, the second device 110*b* (i.e., the secondary device) may have only a subset of the features of the first device 110*a*. As illustrated, the first device 110*a* and second device 110*b* are depicted as wireless earbuds having an inner-lobe insert; as mentioned above, however, the present disclosure is not limited to only wireless earbuds, and any wearable audio input/output system, such as a headset, over-the-ear headphones, or other such systems, is within the scope of the present disclosure.

The devices 110*a*/110*b* may each include a loudspeaker 202*a*/202*b*. The loudspeaker 202*a*/202*b* may be any type of loudspeaker, such as an electrodynamic loudspeaker, electrostatic loudspeaker, dynamic loudspeaker, diaphragm loudspeaker, or piezoelectric loudspeaker. The loudspeaker 202*a*/202*b* may further include one or more drivers, such as balanced-armature drivers. The present disclosure is not limited to any particular type of loudspeaker 202*a*/202*b* or driver.

The devices 110*a*/110*b* may further each include one or more microphones, such as external microphones 204*a*/204*b* and/or internal microphones 205*a*/205*b*. The microphones 204*a*/204*b* and 205*a*/205*b* may be any type of microphone, such as a piezoelectric or MEMS microphone. The loudspeakers 202*a*/202*b* and microphones 204*a*/204*b* and 205*a*/205*b* may be mounted on, disposed on, or otherwise connected to frame elements 206*a*/206*b*. The devices 110*a*/110*b* may each further include inner-lobe inserts 208*a*/208*b* that may bring the loudspeakers 202*a*/202*b* closer to the eardrum of the user and/or block some ambient noise. The internal microphones 205*a*/205*b* may be disposed in or on the inner-lobe inserts 208*a*208*b* or in or on the loudspeakers 202*a*/202*b*. The external microphones 204*a*/204*b* may be disposed in or on the frame elements 206*a*/206*b*.

Figure 3:
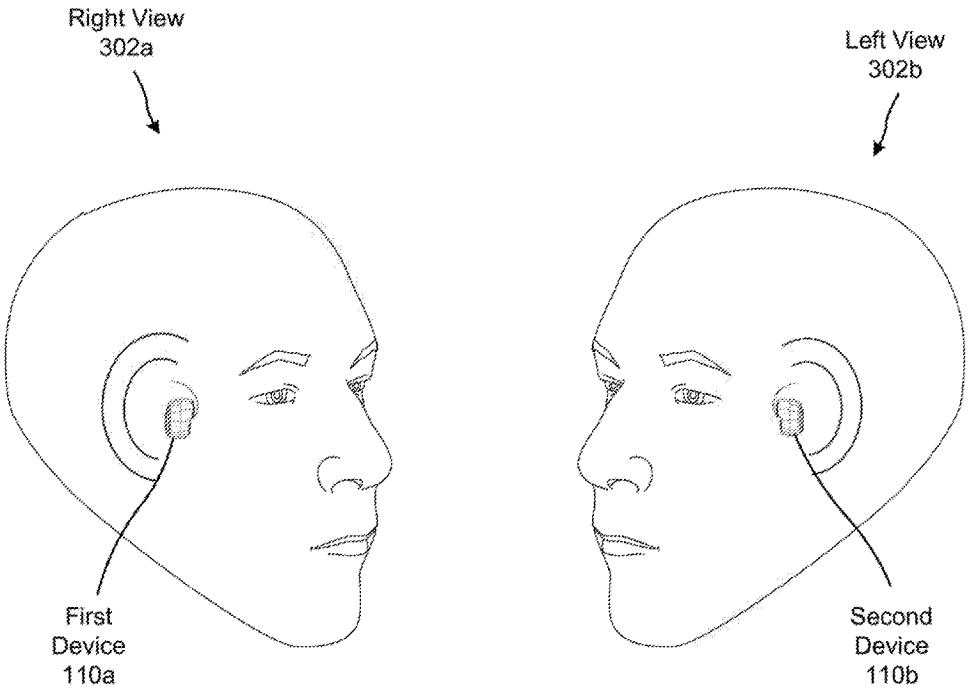
FIG. 3 are conceptual diagrams of noise-cancelling audio devices in use according to embodiments of the present disclosure.

One or more additional components may be disposed in or on the frame elements 206*a*/206*b*. One or more antennas 210*a*/210*b* may be used to transmit and/or receive wireless signals over the first connection 114*a* and/or second connection 114*b*; an I/O interface 212*a*/212*b* contains software and hardware to control the antennas 210*a*/210*b* and transmit signals to and from other components. A processor 214*a*/214*b* may be used to execute instructions in a memory 216*a*/216*b*; the memory 216*a*/216*b* may include volatile memory (e.g., random-access memory) and/or non-volatile memory or storage (e.g., flash memory). One or more sensors 218*a*/218*b*, such as accelerometers, gyroscopes, or any other such sensor may be used to sense physical properties related to the devices 110*a*/110*b*, such as orientation; this orientation may be used to determine whether either or both of the devices 110*a*/110*b* are currently disposed in an ear of the user (i.e., the "in-ear" status of each device). FIG. 3 illustrates a right view 302*a* and a left view 304*b* of a user of the first device 110*a* and the second device 110*b*.

Figure 4:
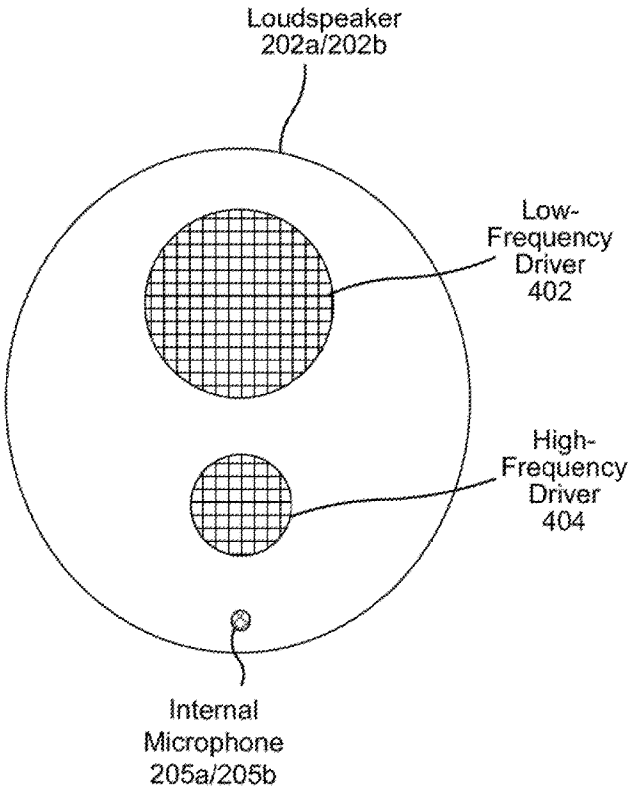
FIG. 4 illustrates a loudspeaker with noise cancelling according to embodiments of the present disclosure.

FIG. 4 illustrates a loudspeaker 202*a*/202*b* according to embodiments of the present disclosure. The loudspeaker 202*a*/202*b* includes a low-frequency driver 402 and a high-frequency driver 404. As mentioned above the drivers 402/404 may be balanced-armature drivers. In some embodiments, the low-frequency driver 402 is larger than the high-frequency driver 404 to thereby accommodate the outputting of lower frequencies. The low-frequency driver 402 and a high-frequency driver 404 may, however, be the same size, and they may output different frequencies based at least in part on different geometries, components, and/or circuitry. The internal microphones 205*a*/205*b* may be disposed in or near the loudspeakers 202*a*/202*c*.

Figure 5A:
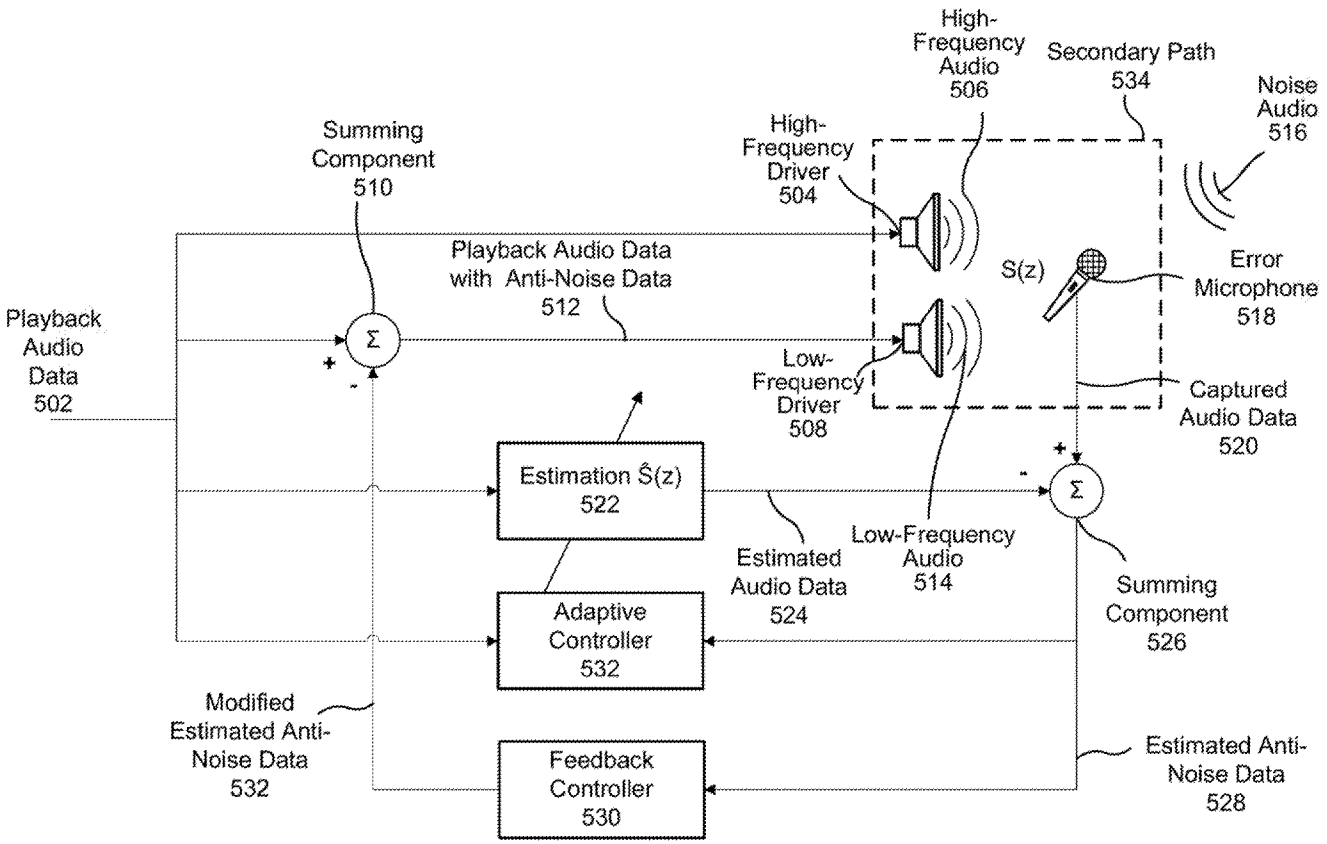
FIGS. 5A, 5B, and 5C are diagrams of components of a noise-cancelling system according to embodiments of the present disclosure.

FIG. 5A illustrates a diagram of a loudspeaker system for use with the first and/or second devices 110*a*/110*b* according to embodiments of the present disclosure. Playback audio data 502 is received from, for example, the third device 112, which, as mentioned above, may be a smartphone, smart watch, tablet, or other such device; the playback audio data 502 may correspond to music, voice, or any other such audio. The first and/or second device 110*a*/110*b* may send the playback audio data 502 to a second, high-frequency driver 504; the second, high-frequency driver 504 may output corresponding high-frequency audio 506. Before the playback audio data 502 is sent to a first, low-frequency driver 508, however, anti-noise data is subtracted using a first summing component 510 to generate playback audio data with anti-noise data 512. The devices 110*a*/110*b* then send the playback audio data with anti-noise data 512 to the first, low-frequency driver 508, which outputs corresponding low-frequency audio data 514. The anti-noise data in the low-frequency audio 514 cancels some or all of noise audio 516.

In various embodiments, the anti-noise data may be generated by modifying the playback audio data 502 with the noise audio 516. The modification may include subtracting an estimation of the noise audio 516 from the playback audio data 502 or adding an estimation of anti-noise audio corresponding to the noise audio EEX16 to the playback audio data 502. The present disclosure is not limited to any particular method for modifying the playback audio data 502 with the noise audio 516.

In some embodiments, an error microphone 518 captures the high-frequency audio 506, the low-frequency audio 514, and the noise audio 516 to create captured audio data 520. The devices 110*a*/110*b* may directly subtract the captured audio data 520 directly from the playback audio data 502 to thereby cancel some or all of the noise audio 516. This direct subtraction, however, also subtracts some or all of the captured high-frequency audio 506 and low-frequency audio 514, thereby distorting playback of the playback audio data 502. In some embodiments, some or all of the playback audio data 502 may be amplified before the devices 110*a*/110*b* send the amplified playback audio data 502 for output by the drivers 504/506 to mitigate this distortion.

In various embodiments of the present disclosure, a transfer function $\hat{S}(z)$ 522 corresponding to the transfer function S(z) 534 is configured to generate estimated audio data 524; this estimated audio data 524 may correspond to the playback audio data 502 as it is received by the error microphone 518. In other words, the estimated audio data 524 corresponds to the playback audio data 502 as modified by the transfer function $\hat{S}(z)$ 522—but not including the noise data 516. A second summing component 526 may then be used to subtract the estimated audio data 524 from the captured audio data 520 to thereby create estimated anti-noise data 528. The first summing component 510 may then subtract the estimated anti-noise data 528 from the playback audio data 502 for output by the first, low-frequency driver 508. In some embodiments, a feedback controller 530 may be used to modify the estimated anti-noise data 528 to create modified estimated anti-noise data 532 prior to sending to the first summing component 510. The feedback controller 530 may, for example, delay or change the phase of the estimated anti-noise data 528 using, for example, one or more additional FIR filters. In some embodiments, the feedback controller 530 includes one or more crossover filters for isolating low-frequency sounds from the estimated anti-noise data 528.

In various embodiments, the transfer function $\hat{S}(z)$ 522 includes one or more FIR filters. An FIR filter may modify audio data by applying one or more coefficients—which may also be referred to herein as "parameters," "variables," or "taps"—to one or more samples of audio data; the number of coefficients may be represented by a length N of the filter. In other words, an FIR filter outputs a series of weighted averages of its N most recent input samples. By updating the coefficients, the adaptive controller may configure the FIR filter to be a low-pass filter, a band-pass filter, a high-pass filter, or may shape the input samples in any combination thereof or in accordance with any transfer function. The longer the filter, the more complicated and/or precise the transfer function may be. In some embodiments, the transfer function $\hat{S}(z)$ 522 may be configured to change the delay, but not the phase, of the playback audio data 502. This delay may correspond to a delay associated with the transfer function S(z) 534.

An adaptive controller 532 may be used to change or otherwise update the coefficients of the transfer function $\hat{S}(z)$ 522 such that the transfer function $\hat{S}(z)$ 522 corresponds to the characteristics of the transfer function S(z) 534. In some embodiments, the adaptive controller 532 minimizes a difference between the noise audio 516 and the estimated anti-noise data 528 or minimize a difference between the estimated audio data 524 and the playback audio data 502. In some embodiments, the adaptive controller 532 utilizes a least-means-squares algorithm to compute this error.

Figure 5B:
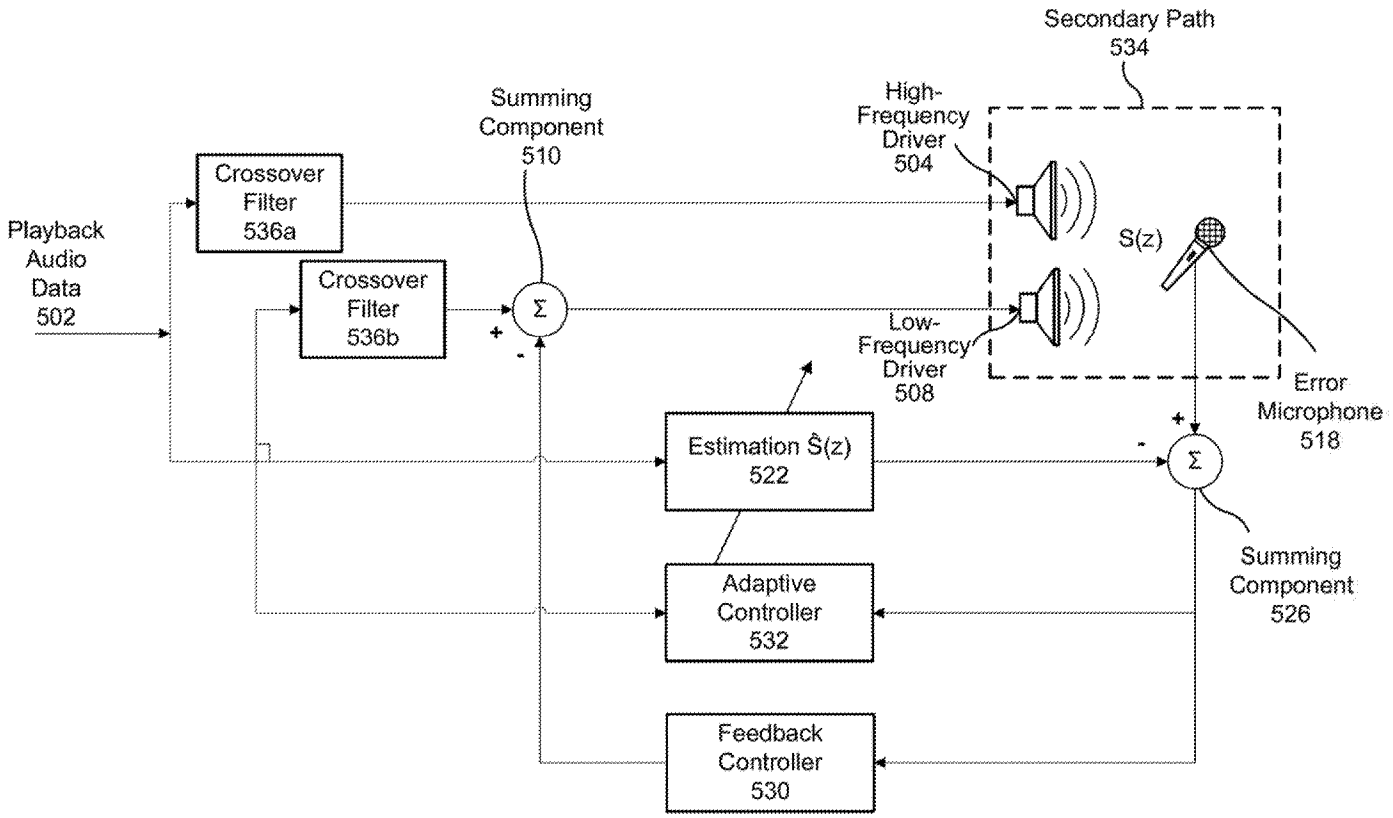

FIG. 5B illustrates a diagram of a loudspeaker system for use with the first and/or second devices 110*a*/110*b* according to embodiments of the present disclosure. In these embodiments, one or more crossover filters 536*a*/536*b* may be used to condition the playback audio data 502 before it is sent to the drivers 504/508. In these embodiments, a first crossover filter 536*a* may correspond to a high-pass filter that passes frequencies greater than a cutoff frequency, e.g., 700 Hz. A second crossover filter 536*b* may correspond to a low-pass filter that passes frequencies less than a cutoff frequency, e.g., 700 Hz. In some embodiments, only the first crossover filter 536*a* or only the second crossover filter 536*b* is used.

Figure 5C:
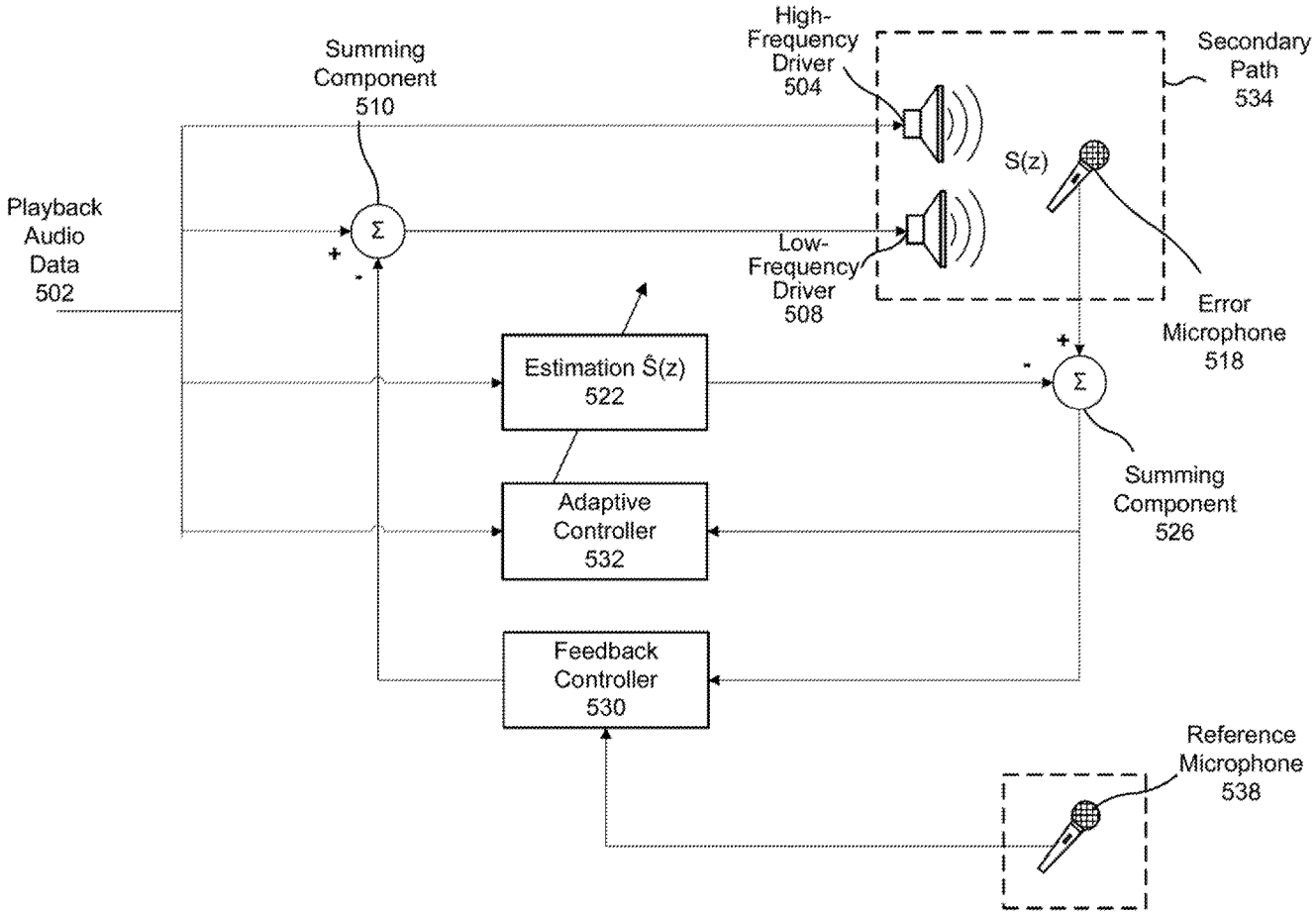

FIG. 5C illustrates another diagram of a loudspeaker system for use with the first and/or second devices 110*a*/110*b* according to embodiments of the present disclosure. In these embodiments, a reference microphone 538 may be used to capture audio data that includes noise audio 516 but does not include, or does not substantially include, the high-frequency audio 506 and/or the low-frequency audio 514. The reference microphone 538 may be, for example, the first external microphone 204*a* and/or the second external microphone 204*b*. For example, the inner-lobe inserts 208*a*/208*b* may prevent some or all of the high-frequency audio 506 and/or the low-frequency audio 514 from reaching the first external microphone 204*a* and/or the second external microphone 204*b* if, for example, the inner-lobe inserts 208*a*/208*b* seal audio within a user's inner ear. Audio data captured by the reference microphone 538 may be used by the feedback controller 530 to generate modified estimated anti-noise data 532 instead of or in addition to using the estimated anti-noise data 528. For example, the audio data captured by the reference microphone 538 may be compared to the estimated anti-noise data 528; the two data may be averaged.

In some embodiments, default coefficients for the FIR filter may be stored in a computer memory. The first and/or second devices 110*a*/110*b* may load these default coefficients into the FIR filter before operating the adaptive controller 532 to dynamically update the FIR filter. This load may take place, for example, upon power-on, upon wake from sleep, periodically, or at any other time. These default coefficients may be determined by, for example, experimentation in a lab with simulated data, with real-world data, or with both. The default coefficients may be selected to represent a typical user and typical use cases. In some embodiments, two or more sets of default coefficients may be determined to represent two or more use cases; the use cases may correspond to different anatomies of users, different environmental conditions, or other such variables. The first and/or second devices 110*a*/110*b* may load these sets of coefficients and select a set based on having a minimum error, as defined above.

In some embodiments, minimum and maximum values for the coefficients may be defined by experimentation, simulation, or other testing. These minimum and maximum values may correspond to the limits at which the FIR filter should operate. If the adaptive controller 532 attempts to change the coefficients outside of these limits, it may cap or peg the coefficients at the limits.

In some embodiments, one of the first and/or second devices 110*a*/110*b* may be unable to determine satisfactory coefficients. The first and/or second device 110*a*/110*b* may determine, for example, that the error is greater than a threshold for a certain period of time. In these embodiments, one of the first and/or second devices 110*a*/110*b* may send a request to the other for its coefficients, and the recipient of the request may determine and transmit its coefficients in response. Similarly, if one of the first and/or second devices 110*a*/110*b* determines that the error is greater than a threshold for a certain period of time, it may permanently or temporarily reduce the volume of the audio data being sent to the second, high-frequency driver to thereby reduce the amount of audio data output by the loudspeaker that is not being cancelled.

Figure 6:
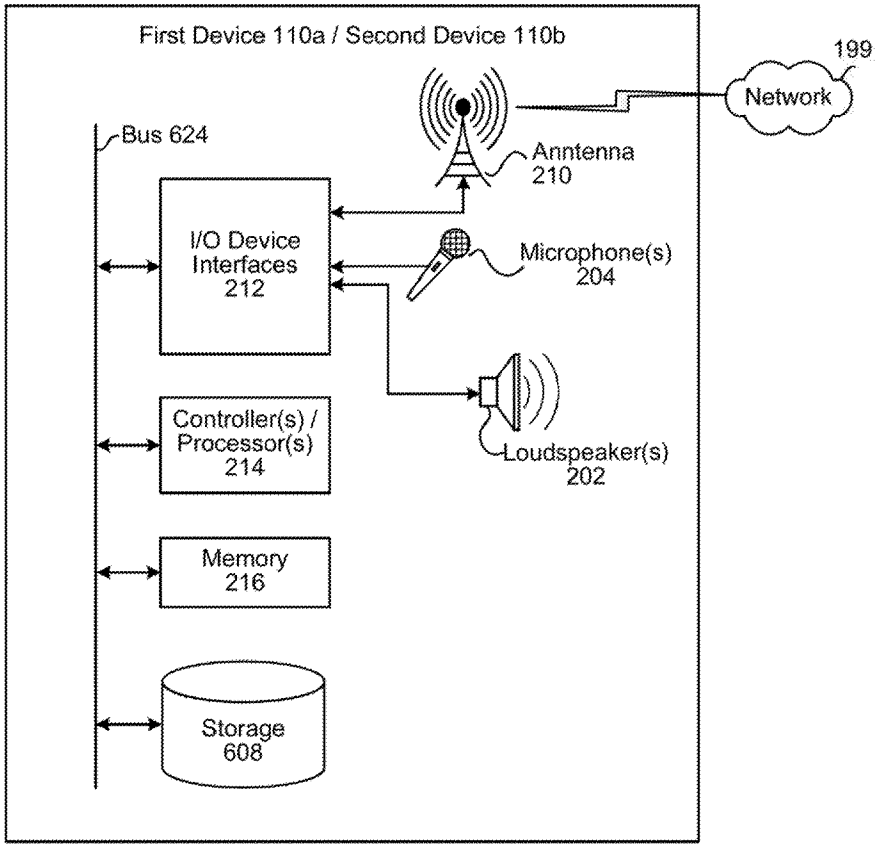
FIG. 6 is a block diagram conceptually illustrating example audio devices according to embodiments of the present disclosure.

FIG. 6 is a block diagram conceptually illustrating a first device 110*a* or second device 110*b* that may be used with the described system. Each of these devices 110*a*/110*b* may include one or more controllers/processors 214, which may each include a central processing unit (CPU) for processing data and computer-readable instructions and a memory 216 for storing data and instructions of the respective device. The memories 2 may individually include volatile random-access memory (RAM), non-volatile read-only memory (ROM), non-volatile magnetoresistive (MRAM) memory, and/or other types of memory. Each device may also include a data-storage component 608 for storing data and controller/processor-executable instructions. Each data-storage component 608 may individually include one or more non-volatile storage types such as magnetic storage, optical storage, solid-state storage, etc. Each device may also be connected to removable or external non-volatile memory and/or storage (such as a removable memory card, memory key drive, networked storage, etc.) through respective input/output device interfaces 2312.

Computer instructions for operating each device 110*a*/110*b* and its various components may be executed by the respective device's controller(s)/processor(s) 214, using the memory 216 as temporary "working" storage at runtime. A device's computer instructions may be stored in a non-transitory manner in non-volatile memory 216, storage 608, or an external device(s). Alternatively, some or all of the executable instructions may be embedded in hardware or firmware on the respective device in addition to or instead of software.

Each device 110*a*/110*b* includes input/output device interfaces 212. A variety of components may be connected through the input/output device interfaces, as will be discussed further below. Additionally, each device 110*a*/110*b* may include an address/data bus 624 for conveying data among components of the respective device. Each component within a device 110*a*/110*b* may also be directly connected to other components in addition to (or instead of) being connected to other components across the bus 624.

For example, via the antenna 210, the input/output device interfaces 212 may connect to one or more networks 199 via a wireless local area network (WLAN) (such as Wi-Fi) radio, Bluetooth, and/or wireless network radio, such as a radio capable of communication with a wireless communication network such as a Long Term Evolution (LTE) network, WiMAX network, 3G network, etc. A wired connection such as Ethernet may also be supported. Through the network(s) 199, the speech processing system may be distributed across a networked environment.

Referring to the device 110*a*/110*b*/112 of FIGS. 8 and 9, the device 110*a*/110*b*/112 may also include input/output device interfaces 31/902 that connect to a variety of components, such as an audio output component like a speaker 302/960 or other component capable of outputting audio. The device 110*a*/110*b*/112 may also include an audio capture component which may be, for example, a microphone 204/205 or array of microphones. The microphone 204/205 may be configured to capture audio. The microphones 204/205 may be used to determine an approximate distance to a sound's point of origin; acoustic localization, based on time and/or amplitude differences between sounds captured by different microphones of the array, i.e., beam forming, may be performed. The device 110*a*/110*b* (using microphone 204/205, wakeword detection, automatic speech recognition, etc.) may be configured to determine audio data corresponding to detected audio. The device 110*a*/110*b* (using input/output device interfaces 212, antenna 210, etc.) may also be configured to transmit the audio data to a remote device 120 for further processing or to process the data using internal components such as a wakeword detection module 229. As a way of indicating to a user that a wireless connection to another device has been created, the device 110*a*/110*b* may be configured with a visual indicator, such as an LED or similar component (not illustrated), that may change color, flash, or otherwise provide visual indications by the device 110*a*/110*b*.

Figure 7:
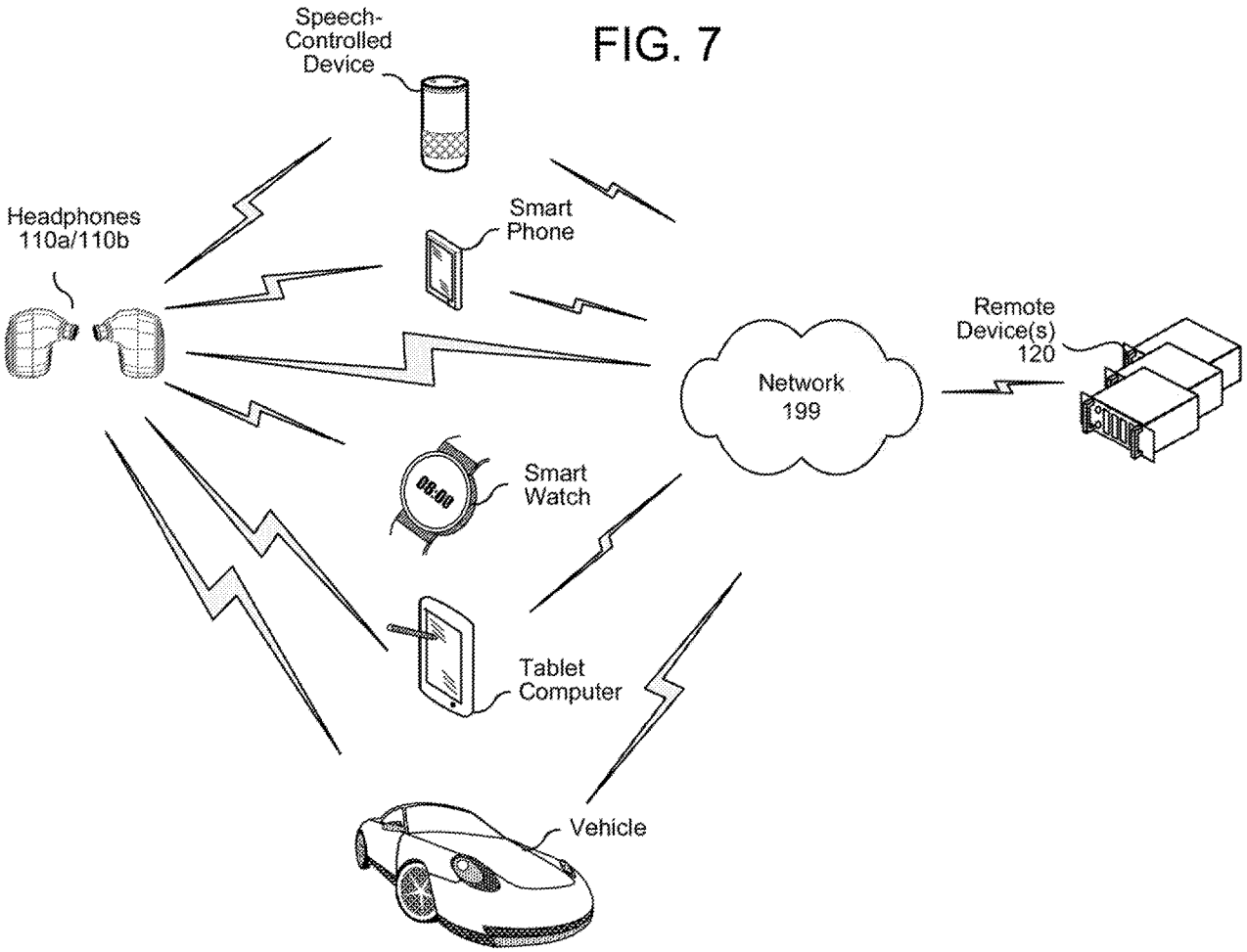
FIG. 7 illustrates an example of a computer network for use with the device provisioning system.

As illustrated in FIG. 7 multiple devices may contain components of the system 100 and the devices may be connected over a network 199. The network 199 may include one or more local-area or private networks and/or a wide-area network, such as the internet. Local devices may be connected to the network 199 through either wired or wireless connections. For example, a speech-controlled device, a tablet computer, a smart phone, a smart watch, and/or a vehicle may be connected to the network 199. One or more remote device(s) 120 may be connected to the network 199 and may communicate with the other devices therethrough. Headphones 110*a*/110*b* may similarly be connected to the remote device(s) 120 either directly or via a network connection to one or more of the local devices.

The above aspects of the present disclosure are meant to be illustrative and were chosen to explain the principles and application of the disclosure; they are not intended to be exhaustive or to limit the disclosure. Many modifications and variations of the disclosed aspects may be apparent to those of skill in the art. Persons having ordinary skill in the field of computers, wearable devices, and speech processing will recognize that components and process steps described herein may be interchangeable with other components or steps, or combinations thereof, and still achieve the benefits and advantages of the present disclosure. Moreover, it will be apparent to one skilled in the art that the disclosure may be practiced without some or all of the specific details and steps disclosed herein. As the term is used herein, "component" may be interchanged with similar terms, such as "module" or "engine."

Aspects of the disclosed system may be implemented as a computer method or as an article of manufacture, such as a memory device or non-transitory computer readable storage medium. The computer-readable storage medium may be readable by a computer and may comprise instructions for causing a computer or other device to perform processes described in the present disclosure. The computer-readable storage medium may be implemented by a volatile computer memory, non-volatile computer memory, hard drive, solid-state memory, flash drive, removable disk, and/or other media. In addition, components of system may be implemented in firmware and/or hardware, such as an acoustic front end (AFE), which comprises, among other things, analog and/or digital filters (e.g., filters configured as firmware to a digital signal processor (DSP)).

Conditional language used herein, such as, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements, and/or steps are in any way required for one or more embodiments or that one or more embodiments necessarily include logic for deciding, with or without other input or prompting, whether these features, elements, and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present. As used in this disclosure, the term "a" or "one" may include one or more items unless specifically stated otherwise. Further, the phrase "based on" is intended to mean "based at least in part on" unless specifically stated otherwise.

What is claimed is:

1. A wireless earbud comprising:

a loudspeaker disposed in an inner-lobe insert of the wireless earbud, the loudspeaker comprising:
a low-frequency driver; and
a high-frequency driver;

a microphone disposed in the inner-lobe insert;

a cavity separating the microphone from the low-frequency driver and the high-frequency driver, the cavity corresponding to a transfer function; and a memory comprising instructions that, when executed by at least one processor, cause the wireless earbud to:
receive first playback audio data;
output, using the low-frequency driver, first low-frequency audio corresponding to the first playback audio data;
output, using the high-frequency driver, first high-frequency audio corresponding to the first playback audio data; and
receive, from the microphone, audio data including:
low-frequency audio data corresponding to the first low-frequency audio, high-frequency audio data corresponding to the first high-frequency audio, and
noise audio data corresponding to ambient noise;
receive second playback audio data;
generate, using a finite-impulse response (FIR) filter and the second playback audio data, estimated audio data using an estimate of the transfer function;
generate cancellation data by subtracting the estimated audio data from the audio data;
output, using the low-frequency driver, second low-frequency audio corresponding to the cancellation data subtracted from the second playback audio data; and
output, using the high-frequency driver, second high-frequency audio corresponding to the second playback audio data.

2. The wireless earbud of claim 1, wherein the memory further comprises instructions that, when executed by the at least one processor, cause the wireless earbud to:

compare, using a least-mean-squares algorithm, the noise audio data and the cancellation data to determine error data, the error data corresponding to a difference between the noise audio data and the cancellation data; and based at least in part on determining that a gradient associated with the error data is positive, configure the FIR filter in accordance with the gradient.

3. A computer-implemented method, the method comprising:

outputting, using a low-frequency driver, first audio;

outputting, using a high-frequency driver, second audio corresponding to first output audio data;

receiving, from a microphone, input audio data corresponding to a representation of the first audio, a representation of the second audio, and a representation of noise audio;

determining a transfer function corresponding to a cavity extending from the low-frequency driver and the high-frequency driver to the microphone;

generating, based at least in part on the transfer function and the first output audio data, estimated audio data;

generating cancellation audio data by subtracting the estimated audio data from the input audio data;

generating feedback audio data from the cancellation audio data;

receiving second output audio data;

outputting, using the low-frequency driver, audio corresponding to the feedback audio data subtracted from the second output audio data; and outputting, using the high-frequency driver, audio corresponding to the second output audio data.

4. The computer-implemented method of claim 3, further comprising:

determining error data corresponding to a difference between the estimated audio data and the first output audio data;

determining that a gradient associated with the error data is positive; and based at least in part on determining that the gradient is positive, increasing a coefficient of a first filter.

5. The computer-implemented method of claim 3, further comprising:

receiving, from a device, playback audio data;

generating, using a first filter, first audio data, the first audio data substantially above a cutoff frequency; and generating, using the first filter, second audio data, the second audio data substantially below the cutoff frequency.

6. The computer-implemented method of claim 3, wherein generating the feedback audio data further comprises:

receiving the cancellation audio data; and applying, using a first filter, low-pass filter coefficients to the cancellation audio data, wherein the feedback audio data substantially corresponds to frequencies below a cutoff frequency.

7. The computer-implemented method of claim 3, further comprising:

prior to outputting the first audio and prior to outputting the second audio, determining default coefficients corresponding to the transfer function; and configuring a first filter in accordance with the default coefficients, wherein the estimated audio data corresponds to an output of the first filter.

8. The computer-implemented method of claim 3, further comprising:

determining first coefficients corresponding to a first estimation of the transfer function;

configuring a first filter in accordance with the first coefficients;

determining first error data corresponding to the first filter;

determining second coefficients corresponding to a second estimation of the transfer function;

configuring the first filter in accordance with the second coefficients;

determining second error data corresponding to the first filter;

determining that a magnitude of the first error data is greater than a magnitude of the second error data; and selecting the first coefficients, wherein generating the estimated audio data further comprises configuring a filter using the first coefficients.

9. The computer-implemented method of claim 3, further comprising:

receiving, from a second microphone, reference audio data corresponding to the noise audio;

determining a difference between the cancellation audio data and the reference audio data;

generating second cancellation audio data based on the cancellation audio data and the reference audio data;

receiving third output audio data; and outputting, using the low-frequency driver, audio corresponding to the second cancellation audio data subtracted from the third output audio data.

10. The computer-implemented method of claim 3, further comprising:

receiving, from the microphone, second input audio data corresponding to a representation of second noise audio;

generating, based at least in part on the transfer function and the second input audio data, second cancellation audio data;

generating second feedback audio data from the second cancellation audio data; and outputting, using the low-frequency driver, audio corresponding to the second feedback audio data.

11. The computer-implemented method of claim 3, further comprising:

determining error data corresponding to a difference between the estimated audio data and the first output audio data;

determining that a magnitude of the error data is greater than a threshold;

receiving third output audio data;

generating reduced-volume third output audio data by reducing a volume level of the third output audio data; and outputting, using the high-frequency driver, the reduced-volume third output audio data.

12. A system comprising:

at least one processor; and at least one memory including instructions that, when executed by the at least one processor, cause the system to:

output, using a low-frequency driver, first audio;

output, using a high-frequency driver, second audio corresponding to first output audio data;

receiving, from a microphone, input audio data corresponding to a representation of the first audio, a representation of the second audio, and a representation of noise audio;

determine a transfer function corresponding to a cavity extending from the low-frequency driver and the high-frequency driver to the microphone;

generate, based at least in part on the transfer function and the first output audio data, estimated audio data;

generate cancellation audio data by subtracting the estimated audio data from the input audio data;

generate feedback audio data from the cancellation audio data;

receive second output audio data;

output, using the low-frequency driver, audio corresponding to the feedback audio data subtracted from the second output audio data; and output, using the high-frequency driver, audio corresponding to the second output audio data.

13. The system of claim 12, wherein the at least one memory further includes instructions that, when executed by the at least one processor, further cause the system to:

determine error data corresponding to a difference between the estimated audio data and the first output audio data;

determine that a gradient associated with the error data is positive; and based at least in part on determining that the gradient is positive, increase a coefficient of a first filter.

14. The system of claim 12, wherein the at least one memory further includes instructions that, when executed by the at least one processor, further cause the system to:

receive, from a device, playback audio data;

generate, using a first filter, first audio data, the first audio data substantially above a cutoff frequency; and generate, using the first filter, second audio data, the second audio data substantially below the cutoff frequency.

15. The system of claim 12, wherein the at least one memory further includes instructions that, when executed by the at least one processor, further cause the system to:

receive the cancellation audio data; and apply, using a first filter, low-pass filter coefficients to the cancellation audio data, wherein the feedback audio data substantially corresponds to frequencies below a cutoff frequency.

16. The system of claim 12, wherein the at least one memory further includes instructions that, when executed by the at least one processor, further cause the system to:

prior to outputting the first audio and prior to outputting the second audio, determine default coefficients corresponding to the transfer function; and configure a first filter in accordance with the default coefficients, wherein the estimated audio data corresponds to an output of the first filter.

17. The system of claim 12, wherein the at least one memory further includes instructions that, when executed by the at least one processor, further cause the system to:

determine first coefficients corresponding to a first estimation of the transfer function;

configure a first filter in accordance with the first coefficients;

determine first error data corresponding to the first filter configured in accordance with the first coefficients;

determine second coefficients corresponding to a second estimation of the transfer function;

configure the first filter in accordance with the second coefficients;

determine second error data corresponding to the first filter configured in accordance with the second coefficients;

determine that a magnitude of the first error data is greater than a magnitude of the second error data; and select the first coefficients, wherein generating the estimated audio data further comprises configuring a filter using the first coefficients.

18. The system of claim 12, wherein the at least one memory further includes instructions that, when executed by the at least one processor, further cause the system to:

receive, from a second microphone, reference audio data corresponding to the noise audio;

determine a difference between the cancellation audio data and the reference audio data;

generate second cancellation audio data based on the cancellation audio data and the reference audio data;

receive third output audio data; and output, using the low-frequency driver, audio corresponding to the second cancellation audio data subtracted from the third output audio data.

19. The system of claim 12, wherein the system comprises an in-ear audio device, and wherein the in-ear audio device comprises the low-frequency driver, the high-frequency driver, and the microphone.

20. The system of claim 12, wherein the at least one memory further includes instructions that, when executed by the at least one processor, further cause the system to:

determine error data corresponding to a difference between the estimated audio data and the first output audio data;

determine that a magnitude of the error data is greater than a threshold;

receive third output audio data;

generate reduced-volume third output audio data by reducing a volume level of the third output audio data; and output, using the high-frequency driver, the reduced-volume third output audio data.

* * * * *